US005870787A

United States Patent [19]

Choi

[11] Patent Number: 5,870,787

[45] Date of Patent: Feb. 16, 1999

[54] DOOR DRIVING CONTROL APPARATUS AND METHOD FOR A WASHING MACHINE

[75] Inventor: Ssi Chol Choi, Suwon, Rep. of Korea

[73] Assignee: Samsung Electronics Co., Ltd., Suwon, Rep. of Korea

[21] Appl. No.: 746,266

[22] Filed: Nov. 8, 1996

[30] Foreign Application Priority Data

Nov. 9, 1995 [KR] Rep. of Korea ..... 95-40472

[51] Int. Cl.[6] ..... D06F 37/30

[52] U.S. Cl. ..... 8/159; 68/12.27; 134/113; 134/201

[58] Field of Search ..... 134/56 D, 57 D, 134/58 D, 113, 200, 56 R, 57 R, 58 R, 18, 25.2, 201; 8/158, 159; 68/12.27, 12.12, 13 R

[56] References Cited

U.S. PATENT DOCUMENTS 2,577,541 12/1951 Resek et al. ..... 200/61.7
2,656,451 10/1953 Rick ..... 68/139
2,677,755 5/1954 Moore ..... 134/113
3,619,592 11/1971 Lamb, Jr. ..... 134/57 D
3,915,180 10/1975 Jacobs ..... 134/113

*Primary Examiner*—Frankie L. Stinson
*Attorney, Agent, or Firm*—Burns, Doane, Swecker & Mathis, L.L.P.

[57] ABSTRACT

There is disclosed door driving control equipment for a washing machine, which washing machine includes an outer casing, a door formed on a top portion of the outer casing, a door motor for generating force used for opening and closing the door, and a lamp for lighting the interior of the washing machine. Also included are: an opening/closing command input portion which is used to input a command to open or close the door to the washing machine; door opening and closing sensing portions that sense whether the door is opened or closed; and a microprocessor which controls operations of the door motor and the lamp according to a command signal to open or close the door and an input signal for the door opening and closing sensing portions, in order to actuate the door motor and the lamp in a prescribed sequence.

12 Claims, 6 Drawing Sheets

31
M
M+
M−
142
TR7
TR2
R9
TR4
D4
D2
VCC
D1
D3
TR1
R8
TR3
144
145
VCC
TR
R4
R3
TR5
TR6
DISPLAY
150
MICRO-PROCESSOR
OP1
OP2
100
C1
R2
R1
VCC
110
28
120
65
130
61

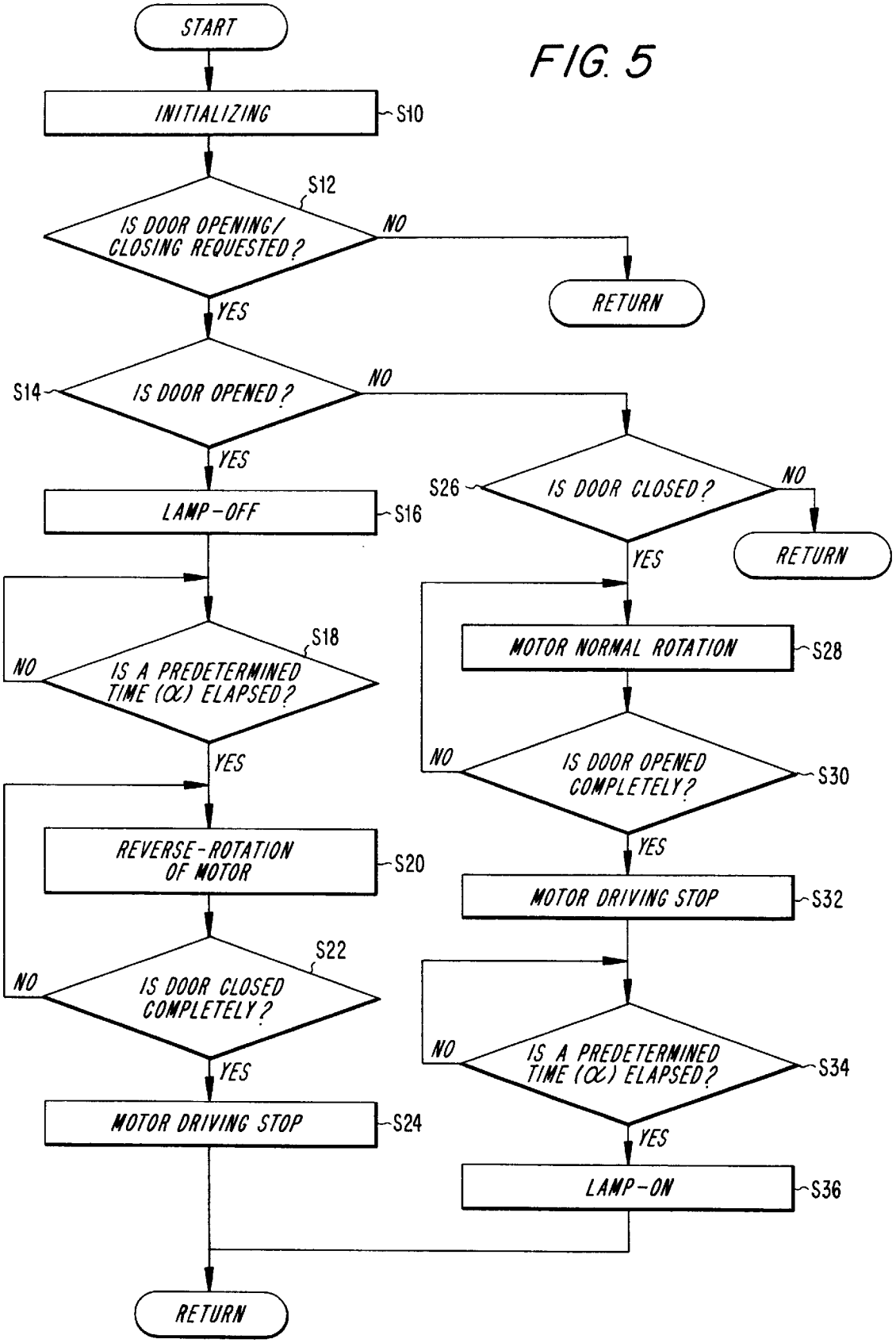
FIG. 5
START
INITIALIZING
S10
S12
IS DOOR OPENING/ CLOSING REQUESTED?
NO
RETURN
YES
S14
IS DOOR OPENED?
NO
YES
LAMP-OFF
S16
S26
IS DOOR CLOSED?
NO
RETURN
YES
S18
NO
IS A PREDETERMINED TIME (α) ELAPSED?
YES
REVERSE-ROTATION OF MOTOR
S20
S22
NO
IS DOOR CLOSED COMPLETELY?
YES
MOTOR DRIVING STOP
S24
MOTOR NORMAL ROTATION
S28
NO
IS DOOR OPENED COMPLETELY?
S30
YES
MOTOR DRIVING STOP
S32
NO
IS A PREDETERMINED TIME (α) ELAPSED?
S34
YES
LAMP-ON
S36
RETURN

ON
REED SWITCH 61
OFF

ON
REED SWITCH 51
OFF

ON
REED SWITCH 28
OFF

ON
DOOR MOTOR
OFF

ON
LAMP
OFF
α
α

DOOR DRIVING CONTROL APPARATUS AND METHOD FOR A WASHING MACHINE

FIELD OF THE INVENTION

The present invention relates generally to a washing machine with an automatic door opening/closing apparatus. More particularly, it relates to a door driving control equipment for a washing machine, in which a lamp for lighting the interior of the washing machine and a door motor for opening and closing the rewashing machine's door are actuated at an interval of a prescribed time according to a command to open or close the door, and the lamp is turned off when the door is closed, and further relates to a method of controlling such a door driving control equipment.

BACKGROUND OF THE INVENTION

A conventional upright washing machine has a door which opens and closes the entrance to water and laundry tubs on the top of a main body of the washing machine. The door of the washing machine is opened and closed frequently according to various occasions, that is, when a bundle of clothes are either put into or taken out of the laundry tub for washing or for drying, when a detergent for cleaning clothing and an agent for rinsing are put into the tub, when laundry is added to the articles that are being washed in the laundry tub, or when you try to properly counteract any out-of-balance condition created by the laundry.

The door of the conventional washing machine is opened and closed by hand, which causes much trouble. Moreover, in recent years, household electric appliances of large capacity are becoming very popular among customers. In line with such a tendency, washing machines are also designed to be of large capacity, and doors used for those washing machines become big and heavy as well. Accordingly, it is difficult for users to open or close the door of the washing machine with the hand.

In order to overcome the above-described problem, there has been proposed a washing machine with an apparatus for automatically opening and closing its door by simple keyboard input.

In addition, the conventional washing machine has a lamp in itself so that laundry can be easily put into or taken out of its laundry tub in the dark. Accordingly, even if such a washing machine with the lamp is located in a room which is not brightly lit up, you can see the amount of the laundry put in the laundry tub of the washing machine very well when you open the door of the washing machine.

According to the conventional art, however, a lamp operating portion and the automatic door opening/closing apparatus are individually provided to the washing machine. Even if the automatic door opening/closing apparatus and the lamp are integrally installed within the washing machine, the lamp is designed to be turned on or off according to door opening or closing. In other words, a motor for the automatic door opening/closing apparatus (door motor) and the lamp operating portion operate from a single power supply, and power is applied to both of them at a time so that the lamp is turned on or off, simultaneously with the operation of the door motor. This creates overload with respect to the single power supply, and causes temporary malfunction in two loads.

When taking the above into consideration, it is preferable that the door motor and lamp are constructed to go into action in sequence.

SUMMARY OF THE INVENTION

It is an objective of the present invention to provide a door driving control equipment for a washing machine and a method of controlling the equipment which allows a door motor and a lamp for lighting the washing machine's interior to reliably sustain normal operations during the operation of the washing machine.

It is another objective of the present invention to provide a door driving control equipment for a washing machine and a method of controlling the equipment which enables a lamp used for lighting the washing machine's interior to be turned on or off according to the operation of a door motor.

It is still another objective of the present invention to provide a door driving control equipment for a washing machine and a method of controlling the equipment in which a lamp for lighting the washing machine's interior and a door motor for opening and closing the washing machine's door can be actuated in sequence, and the lamp is turned off when the door is closed.

To accomplish these and other advantages, the inventive door driving control equipment for a washing machine with an outer casing, a door formed on the top of the outer casing, a door motor generating power used for opening and closing the door, and a lamp lighting the outer casing's interior, includes an opening/closing command input portion which is used to input a command to open or close the door to the washing machine; door opening and closing sensing portions that sense the opening and closing of the door; and a microprocessor which controls operations of the door motor and the lamp according to a command to open or close the door and an input signal of the door opening and closing sensing portions in order to actuate the door motor and the lamp in sequence.

Thus, if there is a command to close the door and the door opening sensing portion detects that the door is being opened, the lamp is turned off first, and the door motor is controlled to close the door. On the contrary, if there is a command to open the door and the door closing sensing portion determines that the door is being closed, the door motor is first controlled to open the door and the lamp is turned on.

According to another aspect of the present invention, there is disclosed a method of controlling a door driving control equipment for a washing machine having an outer casing, a door formed on the top of the outer casing, a door motor generating power used for opening and closing the door, and a lamp turned on when the door is opened to light the outer casing's interior, including the steps of determining if a command to open or close the door is input to the washing machine; and actuating the door motor and the lamp in sequence or in the reverse order when opening or closing the door according to the command to open or close the door.

BRIEF DESCRIPTION OF THE ATTACHED DRAWINGS

FIG. 5 is a flow chart for describing the procedure of controlling the door driving control equipment of the automatic door opening/closing apparatus for a washing machine in accordance with the present invention.

DETAILED DESCRIPTION OF PREFERRED EMBODIMENT

Reference will now be made in detail to the preferred embodiments of the present invention, examples of which are illustrated in the accompanying drawings.

Figure 1:
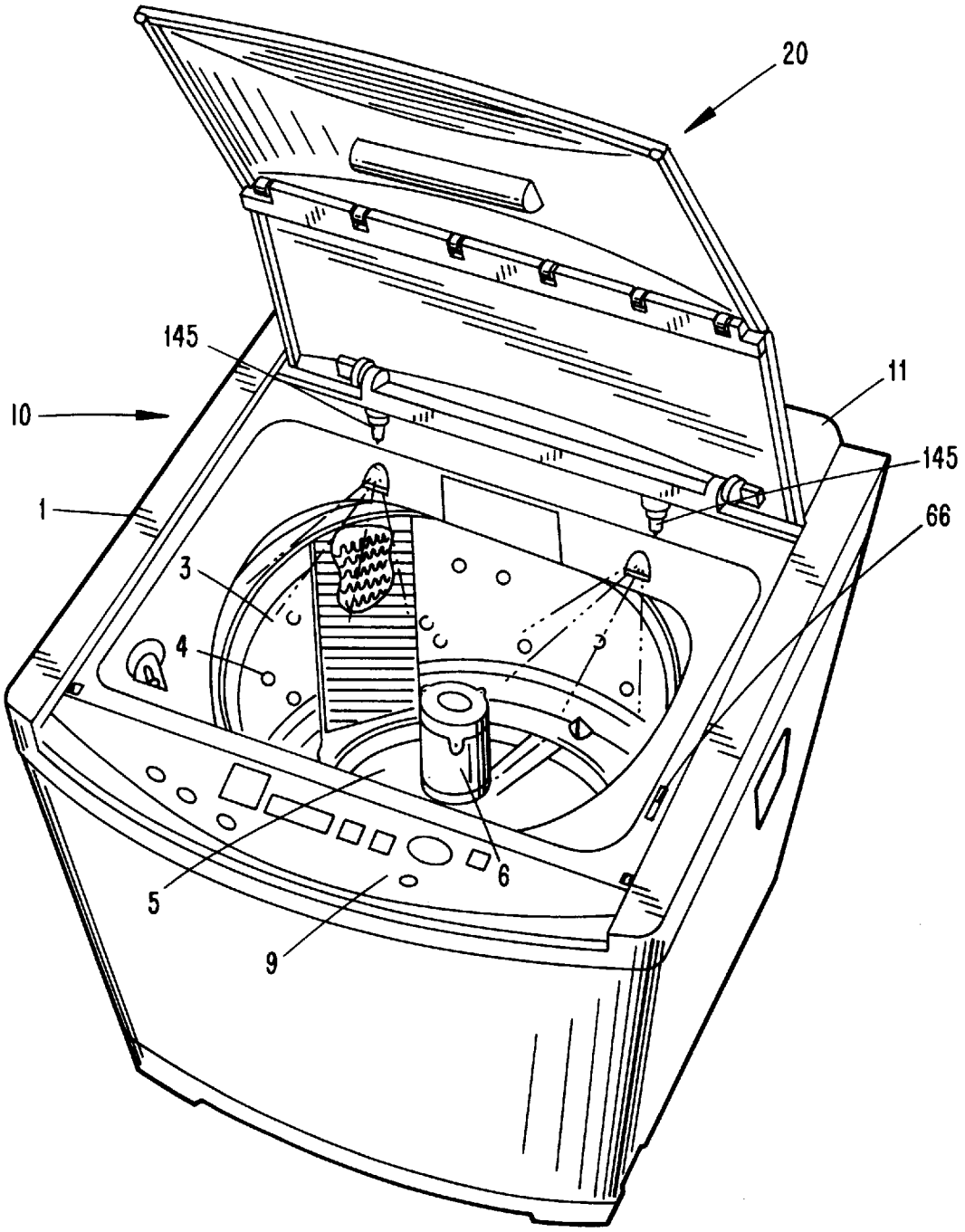
FIG. 1 illustrates a perspective view of a full-automatic washing machine constructed in accordance with the present invention.

FIG. 1 illustrates a perspective view of a full-automatic washing machine 10 constructed in accordance with the present invention.

As shown in FIG. 1, the washing machine 10 includes an outer casing 1, and a water tub (not illustrated in FIG. 1) and a laundry tub 3 provided within the outer casing 1. Within the laundry tub 3, a pulsator 5 is rotatably mounted in the laundry tub 3 and is connected with a power transfer unit (not illustrated). A vortex flow generating cam 6 is mounted on the center of the pulsator 5 to turn with the rotation of the pulsator 5. A door 20 is formed on the top of the outer casing 1, and opens and closes an entrance 8 through which articles to be washed can be put into the laundry tub 3.

On the front of the door 20, there is an operation panel 9 which visually informs users of external pressure and system operations, a box type body 11 at the rear end of the door 20, and at least one lamp 145 provided in front of the box type body 11.

A close sensor for sensing the closing of the washing machine's door 20 is realized through a reed switch 65 fixed onto the front end of the door 20, and a permanent magnet 66 is formed on one side of the top of the washing machine so as to be opposite to the reed switch 65. The other components and elements not described herein are fully shown in FIG. 2.

Figure 2:
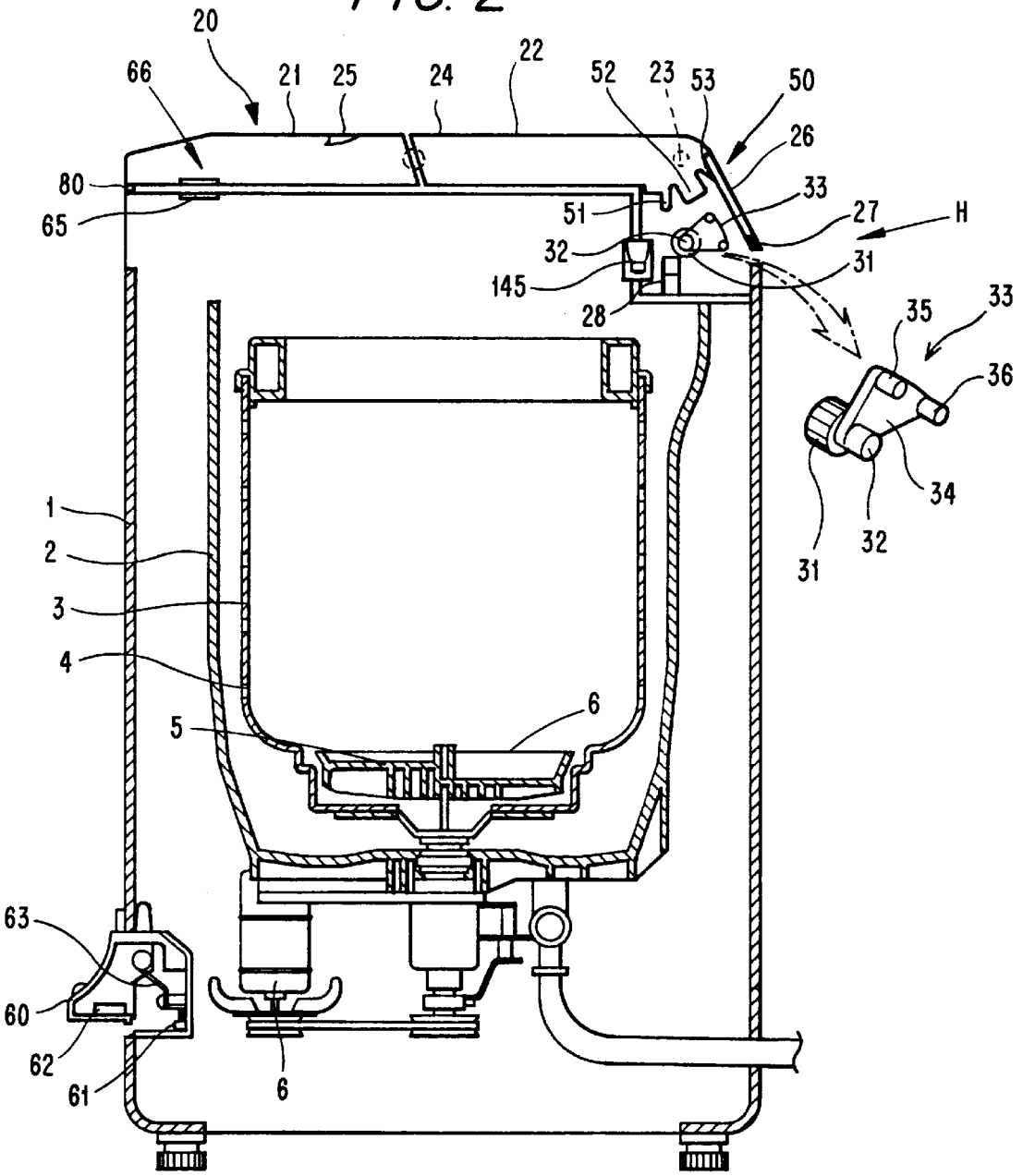
FIG. 2 shows a side-sectional view of an automatic door opening/closing apparatus for a washing machine constructed in accordance with the present invention.

FIG. 2 shows a side-sectional view of an automatic door opening/closing apparatus for a washing machine constructed in accordance with the present invention.

A cylindrical-shaped water tub 2 is placed inside of the outer casing 1, and the laundry tub 3 is rotatably mounted in the water tub 2 and has a plurality of holes 4 so as to be in continual communication with the water tub 2.

As described above, the door 20 is disposed on the top of the main body 1 to open and close the entrance 8 to the water and laundry tubs 2 and 3. The door 20 may be divided into a front half member 21 and a rear half member 22 which cover the front and rear of the top of the main body 1 respectively. The door 20 is formed to turn around a first hinge 23 fixedly formed at the rear end of the main body 1, and the rear end of the front half member 21 is joined to the front end of the rear half member 22 by the use a second hinge 24.

Accordingly, once the door 20 is opened, the front half member 21 can be bent close to the back of the rear half member 22. In this manner, the front half member 21 is connected to the rear half member 22 to freely move up and down with respect to the rear half member 22, and the rear end of the rear half member 22 is joined to the rear end of the main body 1 so as to swing around it.

On a spot close to the first hinge 23, there is a driving/rotating means 30 for allowing the door 20 to rotate forward or reverse. The driving/rotating means 30 includes a door motor 31 which supplies power to the door 20 for its opening/closing action, and a rotary member 33 which is joined to a rotating shaft 32 of the door motor 31. The rotary member 33 consists of a rotary plate 34 which is formed in fan shape, and first and second bosses 35 and 36 that protrude circumferentially on the front of the rotary plate 34.

On the rear section of the rear half member 22 of the door 20, there is a cam member 50 close to the first hinge 23. The cam member 50 includes first, second and third teeth 51, 52 and 53. As the rotary member 33 turns with the forward rotation or reverse of the door motor 31 (the movement for opening the door corresponds to a forward rotation), the first and second bosses 35 and 36 come to properly engage with these teeth 51, 52 and 53 by turns to thereby receive rotating force.

On a predetermined spot of the rear section of the main body 1, there is an open sensor which senses the opening of the door 20, preferably, a reed switch 28 that is fixedly mounted, sealed in a member (not illustrated) which is made from a material impervious to water. A permanent magnet 27 is fixed on a lever 26 extending from the rear half member 22. When the door 20 is opened completely by the operation of the automatic door opening/closing apparatus, contacts of the reed switch 28 come to be closed by magnetic force produced from the permanent magnet 27.

On a predetermined spot of the front section of the main body 1, there is an open sensor which monitors the closing of the door 20, preferably, a reed switch 65 that is fixedly mounted, sealed in a member (not illustrated) whose material is impervious to water. A permanent magnet 66 is fixed on a position opposite to the reed switch 65. When the door 20 is closed completely by the operation of the automatic door opening/closing apparatus, the contacts of the reed switch 65 are closed by magnetic force from the permanent magnet 66.

On a predetermined spot of the front-lower section of the main body 1, there is a foot switch which generates a command to open or close the door 20, preferably, a reed switch 61 that is fixedly mounted, sealed in a member (not illustrated) that is made from a material impervious to water. Contacts of the reed switch 61 may be controlled by magnetic force of a permanent magnet 62 provided to a pedal 60 that is being pulled normally by a leaf spring 63. In other words, as a user pushes the pedal 60 with his foot, the permanent magnet 62 approaches the reed switch 61 to thereby allow the contacts of the reed switch 61 to be closed.

Reference numerals denote the following elements: 25 a handle used to open or close the door 20 manually; 80 a roller used to help the smooth opening/closing action of the door 20; 6 a wash motor.

Various modifications and variations can be made in the location and structure of the open sensor, the close sensor and the reed switch (open/close switch), without limitation to the above-described embodiment. For instance, the reed switch 61 may be disposed on a proper spot of the upper section of the washing machine to be easily handled with the hand. In this case, it is possible to place the reed switch 61 on an operation panel (not illustrated) that is formed on a front top portion of the main body 1 along with other control keys.

According to the preferred embodiment of the present invention, the open sensor 28, the close sensor 65, and the open/close sensor 61 are realized through water-proof reed switches, in consideration of the characteristics of the washing machine in which it performs the washing operation with water, and common-type switches whose contacts are designed for action by mechanical contact may substitute for the inventive reed switches.

In operation, when the door 20 is being closed completely, the first and second bosses 35 and 36 become away from a radius of gyration of the first, second and third teeth 51, 52 and 53 so that the door 20 can be opened or closed by hand.

At this point, if there is a command to open the door 20, i.e. if a user pushes the pedal 60 with the foot, the rotary plate 34 rotates forward. Accordingly, the first boss 35 comes to engage with the first tooth 51 after a predetermined period of time goes by. Under the condition, if the door motor 31 goes on turning forward, the rear half member 22 is raised by degrees, and the second boss 36 engages with the second tooth 52 and rotates.

When the second tooth 52 turns to thereby open the door 20 completely, the second boss 36 comes out of the second tooth 52. About this time, the door motor 31 stops operation, and the rotary plate 34 continues to turn for a predetermined period of time by inertial force acting on the door motor 31. In conclusion, when the door 20 of the washing machine is opened completely, the user is also able to close the door 20 with his hand.

In order to close the door 20 automatically, the automatic door opening/closing apparatus of the present invention undergoes the process in order contrary to the above-described process.

More specifically, if a user pushes the pedal 60 with his foot, the door motor 31 operates to thereby allow the rotary plate 34 to reverse. Accordingly, the second boss 36 comes to engage with the third tooth 53 after a predetermined period of time goes by. Under the circumstances, the door motor 31 goes on reversing to let the rear half member 22 of the door 20 down gradually, and the first boss 35 comes to rotate while engaging with the second tooth 52.

When the second tooth 52 goes on turning to thereby close the door 20 completely, the first boss 35 comes out of the second tooth 52. About this time, the door motor 31 stops operation, and the rotary plate 34 rotates continuously for a predetermined period of time by inertial force acting on the door motor 31. In conclusion, all the electronic components return to the original state.

Figure 3:
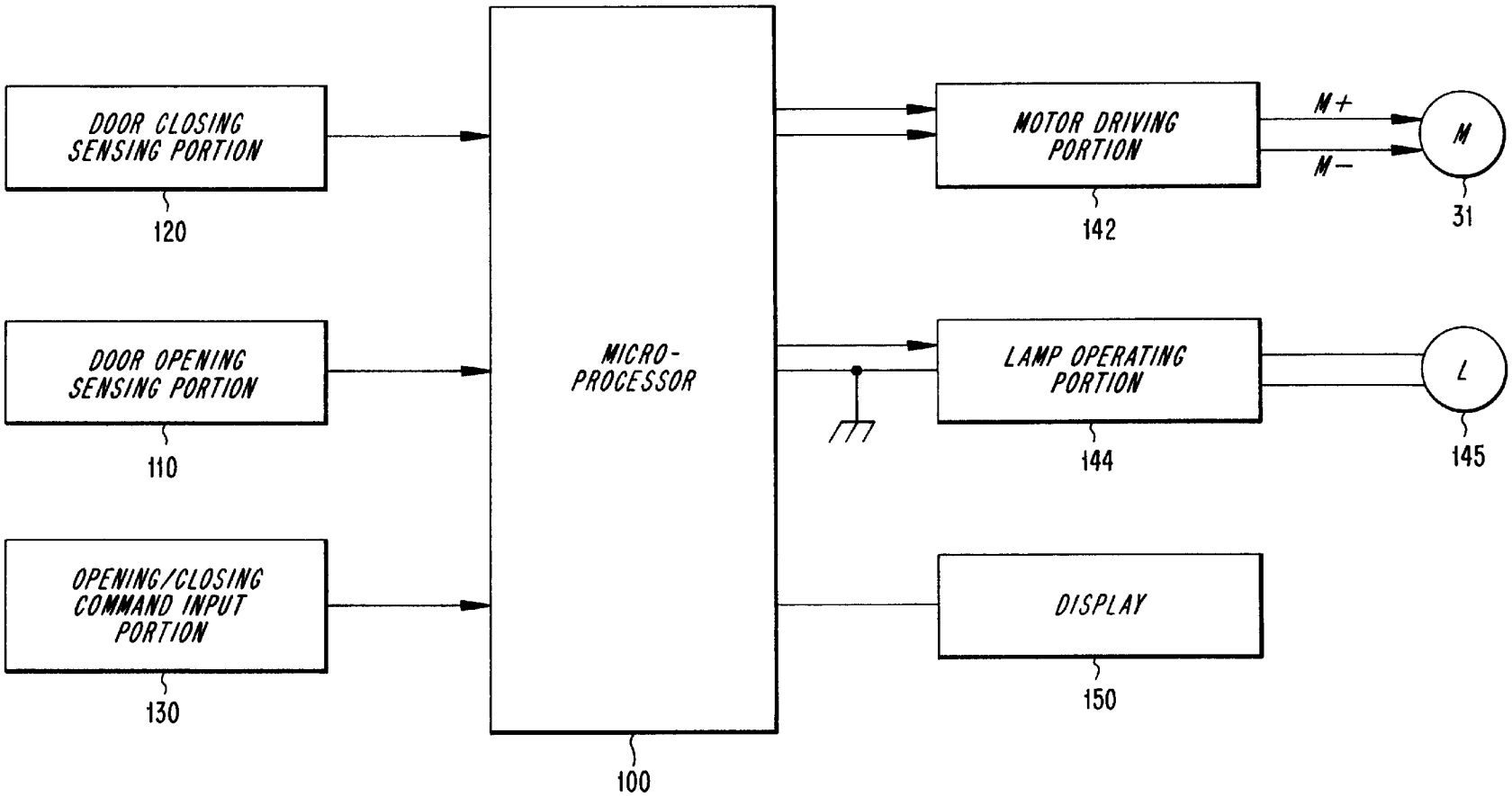
FIG. 3 is a block diagram of a door driving control equipment for a washing machine in accordance with the present invention.
Figure 4:
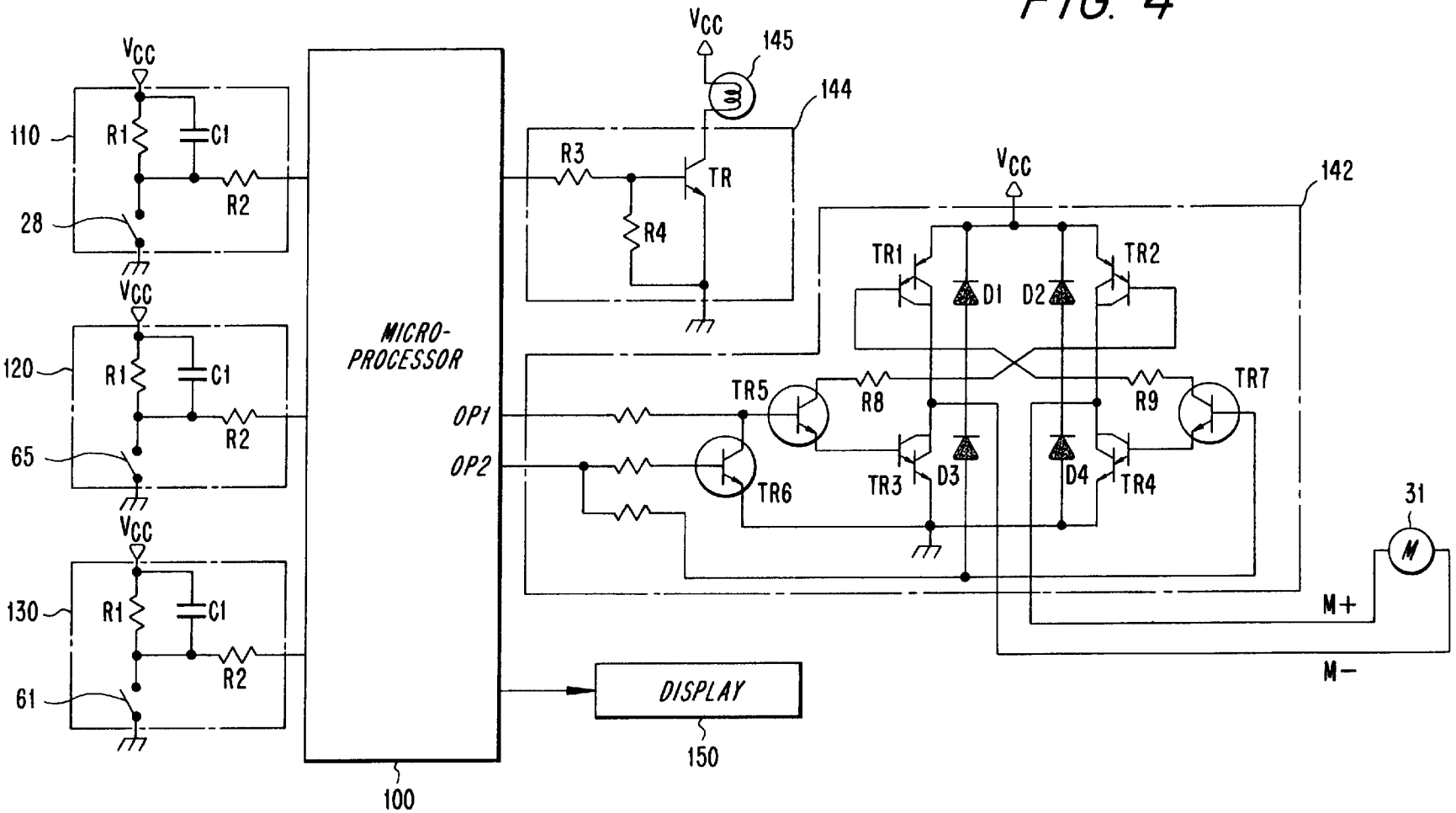
FIG. 4 is a circuit diagram of the door driving control equipment for a washing machine in accordance with the present invention.

FIG. 3 is a block diagram of the automatic door opening/closing apparatus for a washing machine in accordance with the present invention, and FIG. 4 is a circuit diagram of the door driving control equipment of the automatic door opening/closing apparatus for a washing machine in accordance with the present invention.

As shown in FIGS. 3 and 4, the circuitry of the door driving control equipment for a washing machine is realized through an opening/closing command input portion 130 used to input a command to open or close the door 20 to the washing machine, a door opening sensing portion 110 that is employed to sense the opening of the door, a door closing sensing portion 120 that is used to sense the closing of the door, a door motor 31 which generates power for opening and closing the door 20, and a lamp 145 which gives light to the interior of the laundry tub 3.

The door driving control equipment also includes a motor driving portion 142 which energizes the door motor 31, a lamp operating portion 140 which energizes the lamp 145 every time the door 20 is opened, a display 150 which displays various messages during operation, and a microprocessor 100 which has control over the operation of the door 20, referring to the information supplied by the door opening sensing portion 110 and the door closing sensing portion 120 if a command to open or close the door 20 is input through the opening/closing command input portion 130.

The door opening sensing portion 110 and the door closing sensing portion 120 each have the reed switches 28 and 65 respectively connected to supply voltage Vcc via resistors R1, and each secondhand tap between the reed switches 28 and 65 and the resistors R1 is coupled with input terminals of the microprocessor 100 via resistors R2. The door opening and closing sensing portions 110 and 120 have capacitors C1 each coupled in parallel with the resistors R1 and supply voltage Vcc.

The opening/closing command input portion 130 has the reed switch 61 (foot switch) connected to supply voltage Vcc via resistor R1, and a secondhand tap between the reed switch 61 and resistor R1 is connected with an input terminal of the microprocessor 100 via resistor R2. The opening/closing command input portion 130 has a capacitor C1 coupled in parallel with the resistor R1 and supply voltage Vcc.

The lamp operating portion 144 includes a transistor TR connected with an output terminal of the microprocessor 100 via a resistor R3; a resistor R4 coupled in parallel with the resistor R3 and having one end coupled to an emitter terminal of the transistor TR and the other end grounded; the lamp 145 having one end connected with a collector terminal of the transistor TR and the other end connected to supply voltage Vcc.

The motor driving portion 142 includes a plurality of transistors TR1 to TR7 and a plurality of diodes D1 to D4. When the door 20 is opened, a high-level signal is produced from an input/output terminal OP1 of the microprocessor 100 to thereby actuate the transistor TR5. As the transistor TR5 is actuated, base and emitter terminals of the transistor TR3 become enabled. After the signal energizes the motor 31 by way of the diode D3, it actuates the transistor TR2 via the diode D2, and is then input to a collector terminal of the transistor TR5 so that the motor 31 can make a forward rotation.

When it comes to closing the door 20, once a high-level signal is produced from an input/output terminal OP2 of the microprocessor 100, it actuates the transistors TR7 and TR4, and energizes the motor 31 by way of the diode D4. After that, the signal is input to a collector terminal of the transistor TR7 through emitter and base terminals of the transistor TR1 by way of the diode D1, which makes the motor 31 reverse to close the door 20 of the washing machine.

The lamp operating portion 144 and the motor driving portion 142 are supplied with power by a power supply which reduces alternating-current power (AC power) to a predetermined voltage (for example, 12 V) and rectifies it, independently of the microprocessor 100.

When the door 20 is being opened at a predetermined angle and less, the reed switch 28 of the door opening sensing portion 110 is turned off all the time, and a high-level signal is input to the microprocessor 100. When the door 20 is opened at a predetermined angle, e.g. at an angle of 80° or more, the reed switch 65 is turned on by the permanent magnet 66 provided to one-side end of the door 20. Accordingly, a low-level signal is input to the microprocessor 100 so that the door opening sensing portion can detect that the door 20 is completely opened.

When the door closing sensing portion 120 determines that the door 20 is being completely closed, its reed switch 65 comes to be turned on, and a low-level signal is input to the microprocessor 100. When the door 20 is opened at a predetermined angle, e.g. at an angle of 10° or more, the reed switch 65 becomes turned off. Thus, a high-level signal is input to the microprocessor 100 so that the door closing sensing portion 120 may detect that the door 20 is not being closed completely.

FIG. 5 is a flow chart for describing the procedure of controlling the door driving control equipment of an automatic door opening/closing apparatus for a washing machine in accordance with the present invention. FIGS. 6A to 6E are timing diagrams during the operation of the door driving control equipment. As shown in FIG. 5, in the procedure of controlling the door driving control equipment, once power is applied to the microprocessor 100 to thereby initialize the door driving control equipment at step S10, the microprocessor 100 determines (S12) if there is a command to open or close the door 20. By sensing if a driving signal is input to the opening/closing command input portion, the microprocessor 100 determines whether or not there is a command to open or close the door 20.

When the user turns on with the foot the reed switch 61 installed on the lower section of the front of the washing machine, the microprocessor 100 determines that there is a command to open or close the door 20. At this point, when the microprocessor 100 determines (S12) that there is a command to close the door 20, it detects (S14) if the door 20 is being opened right now. Then, the microprocessor 100 determines whether or not the reed switch 28 of the door opening sensing portion 110 is turned on and a low-level signal is input to its input terminal, as shown in FIG. 6B.

Figures 6A, 6B, 6C, 6D, 6E:
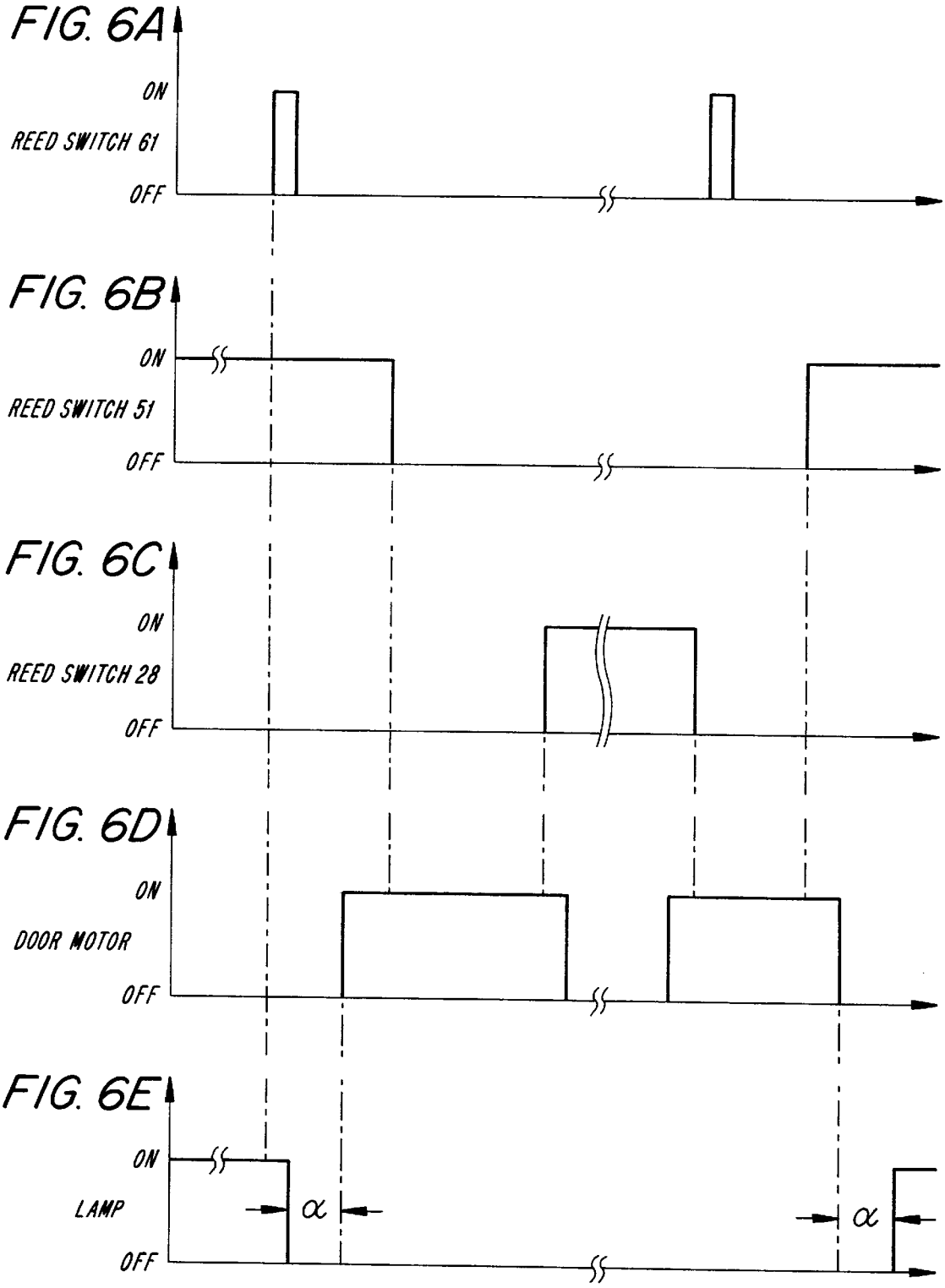
FIGS. 6A, 6B, 6C, 6D and 6E are timing diagrams of electrical signals for describing that a lamp and a door motor go into action in sequence according to the present invention.

When the low-level signal is input to the input terminal of the microprocessor 100 at that time, it determines (S14) that the door 20 is opened, and goes to step 16 to turn off the lamp 145 that was turned on when the door 20 was opened, as shown in FIG. 6E.

Subsequently, the microprocessor 100 goes to step 20 after a predetermined period of time (a of FIG. 6E) has elapsed, and makes the motor 31 reverse to close the door 20. As shown in FIGS. 6B and 6C, if the reed switch 65 of the door closing sensing portion 120 is turned on after the door opening sensing portion 110 has been turned off while the door 20 is being closed by the motor 31, the microprocessor 100 determines (S22) that the door 20 is closed at a predetermined angle and less, and stops (S24) the motor 31, as shown in FIG. 6D.

When the door is not opened at step S14, the microprocessor 100 determines that the door 20 is in closed state, and stops further operation.

When a command to open the door 20 is input to the microprocessor 100, it determines (S26) if the door 20 is in closed state in case that the door 20 is not opened at step 14, i.e. an output signal of the door opening sensing portion 110 attains a high level and an output signal of the door closing sensing portion 120 attains a low level.

When the door 20 is not in closed state, that is, when each output signal of the door opening and closing sensing portions 110 and 120 attains a high level, the door 20 is raised halfway with the user's hand, and the microprocessor 100 either allows messages to be supplied to the user through the display 150 until the microprocessor 100 determines that the door 20 is opened or closed completely, or returns to step 10.

If the microprocessor 100 normally determines (S26) that the door 20 is being closed, it makes (S28) the motor 31 rotate forward as shown in FIG. 6D to open the door 20 thereby. When the motor 31 rotates forward and a predetermined period of time elapses, the reed switch 65 of the door closing sensing portion 120 is turned off as the door 20 is opened (refer to FIG. 6C). When a predetermined period of time elapses more, the door 20 is opened at a prescribed angle or more by the motor 31, as shown in FIG. 6B, so that the reed switch 28 of the door opening sensing portion 110 is turned on.

When an output signal of the door opening sensing portion 110 attains a low level, the microprocessor 100 determines (S30) that the opening of the door 20 is completed, and stops (S32) the motor 31. Since a predetermined counter-electromotive force is produced even after the motor 31 has stopped operation, the microprocessor 100 waits (S34) for the lapse of a predetermined time (a), and allows (S36) the lamp 145 to be turned on for a prescribed period of time so that it can prevent the lamp 145 from being dimmed down by the drop of voltage applied to the lamp 145 due to the counter-electromotive force.

According to the above description made referring to FIGS. 5 and 6A to 6E, the door 20 can be opened or closed automatically when a command to open or close the door 20 is input to the microprocessor 100. In addition, the present invention includes the procedure of turning on the lamp for a predetermined period of time if the door opening sensing portion 110 detects that the door 20 is opened whenever a user opens or closes the door by hand without sending a command to open or close the door to the microprocessor 100 by using the opening/closing command input portion.

As described above, the present invention allows the lamp and the motor to be actuated at an interval of a prescribed time in response to a command to open or close the door, and can prevent the lamp from getting dimmed down by the voltage drop due to the counter-electromotive force. Accordingly, the present invention may offer the advantage that the lamp and door motor can reliably sustain normal operations during the operation of the washing machine.

What is claimed is:

1. In a washing machine having an outer casing, a door formed on a top portion of the outer casing, door opening/closing means for opening and closing the door, and a lamp lighting an interior of the washing machine, a door driving control apparatus for comprising:

opening/closing command input means for inputting a command to open or close the door to the washing machine;

at least one door opening/closing sensing means for sensing opening and closing of the door; and control means for controlling operations of said door opening/closing means and said lamp according to a command to open or close the door input from said opening/closing command input means and an input signal of said sensing means so as to actuate said door opening/closing means and said lamp in a predescribed sequence.

2. A door driving control apparatus as set forth in claim 1, wherein in the event that there is a command to close the door and said door opening sensing means detects that the door is being opened, the lamp is turned off, and thereafter the door opening/closing means is controlled to close the door.

3. A door driving control apparatus as set forth in claim 1, wherein in the event that there is a command to open the door and said door closing sensing means detects that the door is being closed, the door opening/closing means is controlled to open the door, and thereafter the lamp is turned on.

4. A method of controlling door driving control equipment for a washing machine, which washing machine has an outer casing, a door formed on a top portion of the outer casing, door opening/closing means for opening and closing the door, and a lamp that is turned on when the door is opened to light an interior of the washing machine, said method comprising the steps of:

determining if a command to open or close the door is input to the washing machine; and actuating said door opening/closing means and said lamp in a prescribed sequence or in reverse order of the prescribed sequence when opening or closing the door, respectively, according to the command to open or close the door.

5. A method as set forth in claim 4, further comprising the step of:

detecting the opening or closing of the door according to the command to open or close the door.

6. A method as set forth in claim 4, wherein in the event that there is a command to close the door and the opening of the door is detected, the lamp is turned off, and thereafter the door opening/closing means is controlled to close the door.

7. A method as set forth in claim 4, wherein in the event that there is a command to open the door and the closing of the door is detected, the door opening/closing means is controlled to open the door, and thereafter the lamp is turned on.

8. A method as set forth in claim 4, wherein in the event that either one of the door opening/closing means and the lamp is actuated, the other is subsequently actuated following a predetermined period of time.

9. A method for controlling operation of a lamp and an automatic door actuating system in a washing machine, the method comprising the steps of:

sensing for an input of a door actuation command; and operating the automatic door actuating system and controlling the illumination of the lamp in a prescribed sequence pursuant to sensing the input of the door actuation command.

10. The method claimed in claim 9 further comprising the step of:

sensing whether the door is in an open or closed state; and operating the automatic door actuating system and controlling the illumination of the lamp in accordance with the state of the door.

11. The method claimed in claim 10, wherein in the event that a door actuation command to close the door is detected, and sensing of the door state indicates that the door is open, turning off the lamp, and thereafter controlling the automatic door actuating system to close the door.

12. The method claimed in claim 11, wherein in the event that a door actuation command to open the door is detected, and sensing of the door state indicates that the door is closed, controlling the automatic door actuating system to open the door, and thereafter turning on the lamp.

* * * * *